US005761827A

United States Patent [19]

Guasch

[11] Patent Number: 5,761,827

[45] Date of Patent: Jun. 9, 1998

[54] METHOD AND APPARATUS FOR CREATING AIR FLOW IN A WALL, CEILING, OR FLOOR AROUND A PIPE EXTENDING FROM THE WALL, CEILING, OR FLOOR

[76] Inventor: James A. Guasch, 11441 Eastbrook Ave., Los Altos, Calif. 94024

[21] Appl. No.: 715,194

[22] Filed: Sep. 17, 1996

Related U.S. Application Data

[63] Continuation-in-part of Ser. No. 452,270, May 26, 1995, Pat. No. 5,555,643, which is a continuation-in-part of Ser. No. 323,891, Oct. 17, 1994, Pat. No. 5,419,059.

[51] Int. Cl.[6] ..... F26B 5/04

[52] U.S. Cl. ..... 34/413; 34/442; 34/103; 34/104; 285/373; 454/341

[58] Field of Search ..... 34/413, 417, 437, 34/439, 442, 487, 507, 103, 104, 181; 285/373, 419, 365, 409; 454/341, 909

[56] References Cited

U.S. PATENT DOCUMENTS

| | | | |
|---|---|---|---|
| 1,016,435 | 2/1912 | Overholt | 34/611 |
| 1,661,553 | 3/1928 | Baar | 34/201 |
| 2,614,337 | 10/1952 | Darbo | 34/104 |
| 2,969,027 | 1/1961 | Figge | 34/104 |
| 3,052,987 | 9/1962 | Mercer | 34/104 |
| 3,115,567 | 12/1963 | Meltzer | 34/201 |
| 3,805,405 | 4/1974 | Ambos | 34/104 |
| 4,492,005 | 1/1985 | Begley et al. | 285/409 X |
| 5,155,924 | 10/1992 | Smith | 34/443 |
| 5,408,759 | 4/1995 | Bass | 34/104 |
| 5,522,625 | 6/1996 | Flick et al. | 285/409 |

FOREIGN PATENT DOCUMENTS

| | | | |
|---|---|---|---|
| 195402 | 2/1908 | Germany | 34/443 |

*Primary Examiner*—Henry A. Bennett
*Assistant Examiner*—Steve Gravini
*Attorney, Agent, or Firm*—Mallinckrodt & Mallinckrodt

[57] ABSTRACT

Air flow in a hollow wall, ceiling, or floor is created by forcing air into or drawing air out of the wall, ceiling, or floor through a hole around a pipe through which the pipe extends from the wall, ceiling, or floor. The apparatus of the invention includes a body that fits around the pipe to position an end against the wall, ceiling, or floor surrounding the pipe and hole and provides for the connection of an air flow hose thereto. The air flow hose provides a source of pressurized air or a source of vacuum to force air into the wall, ceiling, or floor or draw air therefrom.

12 Claims, 1 Drawing Sheet

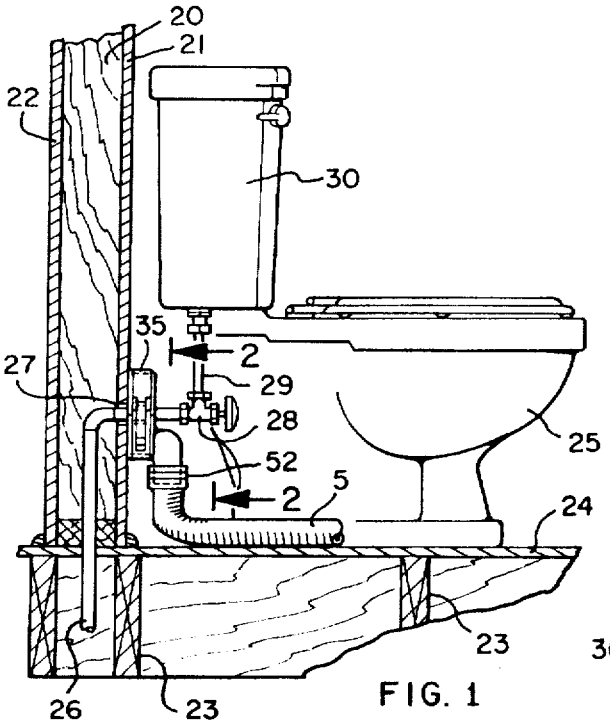
FIG. 1
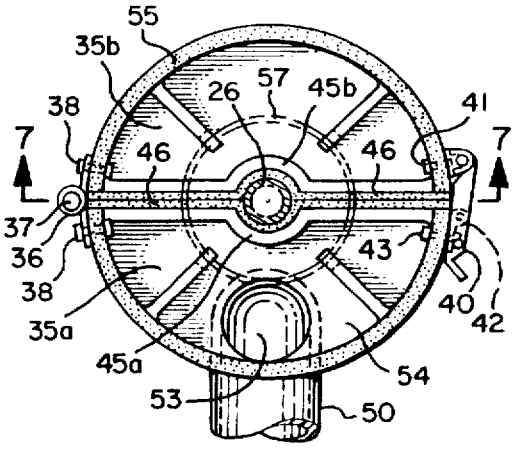
FIG. 6
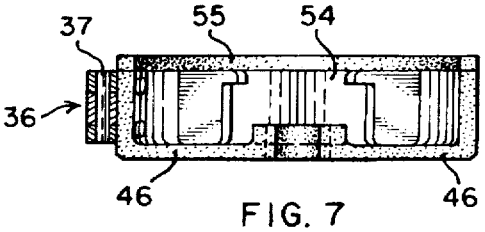
FIG. 7
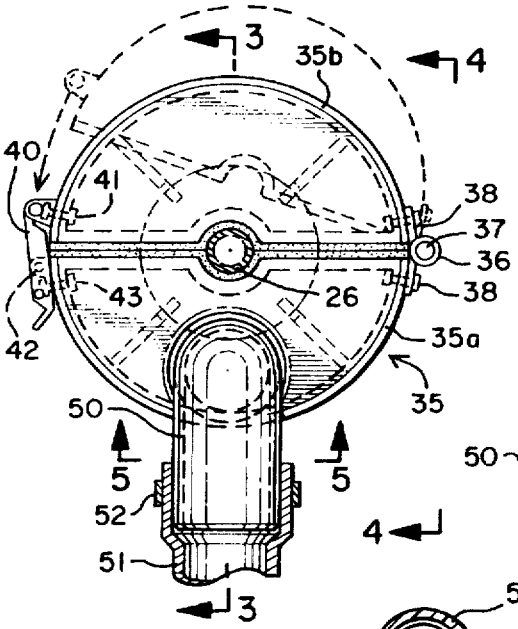
FIG. 2
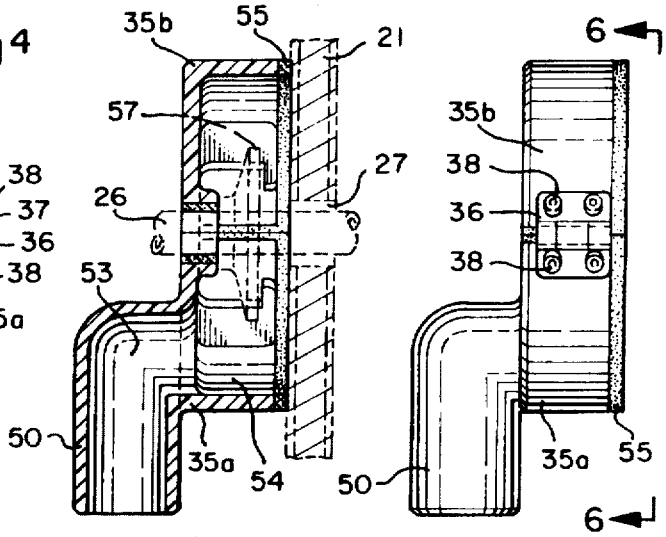
FIG. 3
FIG. 4
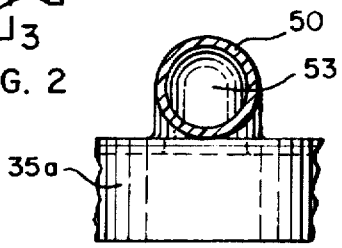
FIG. 5
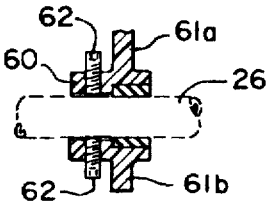
FIG. 8

METHOD AND APPARATUS FOR CREATING AIR FLOW IN A WALL, CEILING, OR FLOOR AROUND A PIPE EXTENDING FROM THE WALL, CEILING, OR FLOOR

RELATED APPLICATIONS

This application is a continuation-in-part of my application for U.S. patent application Ser. No. 08/452,270, filed May 26, 1995, now U.S. Pat. No. 5,555,643, which was a continuation-in-part of application Ser. No. 08/323,891, filed Oct. 17, 1994, now U.S. Pat. No. 5,419,059.

BACKGROUND OF THE INVENTION

1. Field

The invention is in the field of methods and apparatus for drying building walls and ceilings, particularly hollow building walls and ceilings that have become undesirably wet through floods, pipe breakage, fire fighting, or other disasters. It is also in the field of creating air circulation in hollow walls, ceilings, and floors for drying and other purposes.

2. State of the Art

It is current practice in drying hollow walls and ceilings that have become wet to direct a flow of air against such walls or along such walls and ceilings to draw water therefrom. In some cases an attempt is made to circulate air through the walls or ceilings. This is done by drilling or cutting holes or making slits in the walls or ceilings and directing air toward such holes or slits.

U. S. Pat. No. 5,155,924 discloses special diverters which can be placed over expansion slots in a floor or slots made by removing a portion of a floor, or over holes cut through a wall or ceiling to direct flowing air into the floor, walls, or ceiling through such holes. The holes that are made through the floor, walls, or ceiling, must be repaired after the drying process.

My related applications referred to above show an apparatus that can be placed against a wall or ceiling over an electrical box which opens into a hollow wall or ceiling to allow air to be forced under pressure into the wall or ceiling through the electrical box and/or whatever space exists between the electrical box and the surrounding wall or ceiling or air to be similarly sucked out of the wall or ceiling. In many instances pipes, such as water pipes, air conditioning pipes, heating pipes, electrical conduits, or similar items extend through holes in walls, ceilings, or floors. A flange, generally of chrome, is placed around the pipe and against the wall, ceiling, or floor to cover the hole and provide a finished appearance to the pipe installation.

SUMMARY OF THE INVENTION

In many instances a pipe will extend through a hole in a wall, ceiling, or floor. This is particularly common in bathrooms where the toilet water supply pipe extends through a hole in the wall or floor to a valve which then has a line connected to the toilet tank. The holes through which the pipes extend are usually at least slightly larger than the outside diameter of the pipe so that the pipe easily passes therethrough. The space around the pipe is usually large enough to allow pressurized air to be forced into the wall around the pipe or for air to be drawn out of the wall around the pipe. Such holes are usually covered by a flange, usually a chrome flange, placed around the pipe against the wall to cover the hole.

According to the invention, air flow through a wall, ceiling, or floor for drying or other purposes can be enhanced by apparatus which can be secured around a pipe extending through a wall, ceiling, or floor against the wall, ceiling, or floor over the hole around the pipe and in place of or in addition to the normal decorative flange and through which air can be forced into the wall, ceiling, or floor or drawn from the wall, ceiling, or floor. The apparatus includes a conduit body which fits around the pipe and has a first end sized and configured to fit against the wall, ceiling, or floor around the hole through which the pipe extends. The conduit body will normally include hinged body halves which open to be placed in desired position around the pipe and closed and clamped in closed position to substantially secure the body in position on the pipe with the first end against the wall, ceiling, or floor. Gaskets, teeth, or similar means will clamp about the pipe to hold the body in position.

A connecting means such as a connecting nipple extends from the body for connecting an air flow hose to the body and an air flow passage extends from the connecting means to the first end so air can flow therethrough. Thus, an air flow hose connected to a source of pressurized air may be connected to the connecting nipple so that pressurized air is directed from a source, such as a blower, into the wall, ceiling, or floor around the pipe. Alternately, the air flow hose can be connected to a source of vacuum to draw air out of the wall, ceiling, and floor around the pipe.

As indicated in my related applications, the use of existing holes in the walls, ceilings, or floors as inlets or outlets for air eliminates the need for cutting holes in walls, ceilings, or floors in order to induce air flow and thus eliminates the need for repair of such holes after drying is completed as is required with methods of the prior art. Depending upon the configuration of the pipe and the decorative flange used with the pipe, in some instances the flange can be slid along the pipe to provide room for the apparatus of the invention to be placed on the pipe and then slid back in place when the apparatus of the invention is removed. In other instances, the flange can be left in position, or slid a small distance back from the wall to allow air to flow thereby and the apparatus of the invention is placed over the flange. In still other instances, the decorative flange will have to be removed from the pipe so the apparatus of the invention can be placed around the pipe, and the flange replaced or a new flange placed on the pipe when drying is complete. However, even when the flange is removed and has to be replaced, this is much easier than having to repair a hole in a wall, ceiling, or floor.

The invention also provides a method of creating air flow through hollow walls, ceilings, or floors for drying purpose by providing apparatus to direct pressurized air into a wall, ceiling, or floor, or draw air out of a wall, ceiling, or floor through existing holes in the wall, ceiling, or floor around pipes extending from such wall, ceiling, or floor so that new holes that would have to be repaired after drying is completed are not needed. The flow through holes around existing pipes augments the flow created through electrical boxes and the space between a wall or ceiling and electrical boxes as set forth in my related applications.

THE DRAWINGS

The best mode presently contemplated for carrying out the invention is illustrated in the accompanying drawings, in which:

FIG. 1 is a side elevation of a toilet installation with the wall and floor adjacent the toilet shown in vertical section showing the apparatus of the invention installed around the water supply pipe for the toilet;

FIG. 2, a front elevation of the apparatus of the invention taken on the line 2—2 of FIG. 1, and showing the apparatus in partially open condition in broken lines;

FIG. 3, a vertical section taken on the line 3—3 of FIG. 2;

FIG. 4, a side elevation of the apparatus of the invention taken on the line 4—4 of FIG. 2, but not showing the pipe on which it is mounted;

FIG. 5, a transverse section taken on the line 5—5 of FIG. 2;

FIG. 6, a rear view of the apparatus taken on the line 6—6 of FIG. 4;

FIG. 7, a transverse section through the apparatus taken on the line 7—7 of FIG. 6; and FIG. 8, an enlarged fragmentary section of an alternate embodiment of the portion of the apparatus surrounding the pipe.

DETAILED DESCRIPTION OF THE ILLUSTRATED EMBODIMENTS

As shown in FIG. 1, building walls are typically constructed with a series of spaced, vertically oriented studs, one stud 20 being shown, with plaster board 21 secured to one side of the stud 20 to form one side of a hollow wall and plaster board 22 secured to the other side of the stud 20 to form the other side of the hollow wall. Floors are formed by spaced floor joists 23 with floor 24 mounted thereon. FIG. 1 shows a portion of a bathroom with toilet 25 mounted on floor 24. A water supply pipe 26 extends upwardly through floor 24 into the hollow wall and out through hole 27 in plaster board 21 to the normal valve 28. A pipe 29 extends from valve 28 to toilet tank 30. Generally a chrome flange will be placed around pipe 26 as it extends from plaster board 21 to decoratively cover hole 27 around pipe 26. This is currently the standard installation of a toilet water supply pipe. While such installations are common with toilets, there are many other similar installations where pipes of various types will extend through a hole in a wall or similarly through a hole in a floor or ceiling. Examples of such installation are water supply pipes to sinks and basins, natural gas pipes to furnaces, water heaters, and washers and dryers, hot water supply pipes to radiators for heating, electrical conduits for electrical wires or communication wires, etc. The bathroom toilet installation shown in FIG. 1 is merely an example.

The inventor has found that generally the hole in a wall through which a pipe extends is large enough to allow air flow into or out of the wall around the pipe. When air is forced into a wall through and around an electrical box as described in the referenced related applications, air can flow out around pipes extending from the walls. When air is drawn out of a wall through and around an electrical box, air can flow into the wall around such pipes. However, in some instances it will be desirable to force air into the wall around such pipes or draw air out of the wall around such pipes. In such instances, the apparatus of the invention may be used.

A conduit body 35 is made up of body halves **35*a* and 35*b* hinged together at one end by hinge 36 with hinge pin 37. The hinge parts may be molded in known manner as an integral part of the body halves 35*a* and 35*b* or may be a separate hinge unit as shown riveted or otherwise secured to the body halves such as by rivets 38. A closure, such as a spring clip 40, is secured to the other end of one of the halves 35*a* or 35*b*, here shown as half 35*b*, such as by rivets 41 to act with a receiving catch 42 secured to the other half, here half 35*a*, such as by rivets 43, so that the halves 35*a* and 35*b* can be opened (partially opened position is shown in broken lines in FIG. 2) to be placed about a pipe and then closed securely about the pipe 26. Halves 35*a* and 35*b* will generally include centrally located pipe receiving indentation 45*a* and 45*b* for receiving pipe 26. Gasket material 46 may be provided along the mating edges of halves 35*a* and 35*b* to securely and sealingly fit against pipe 26 when the halves are closed. If desired, teeth or other gripping means, not shown, or a set screw arrangement as shown in FIG. 8, may also be provided in association with indentations 45*a* and 45*b* for more securely gripping pipe 26. A nipple 50 extends from one of the body halves, here shown as body half 35*a*, to form a connecting means for connecting to an air flow hose 51, FIGS. 1 and 2. The air flow hose 51 can be connected to nipple 50 in any normal manner such as by friction fit or secured with a clamp 52**.

When body halves **35*a* and 35*b* are closed about pipe 26, they form a conduit body 35 having a first end which is sized and configured to fit circumferentially around the opening or hole 27 through which pipe 26 extends through wall 21. The conduit 35 forms an air flow passage 53 which includes an open chamber 54 in the first end of the body which, when body 35 is placed over a pipe and against a wall, ceiling, or floor through which the pipe extends, communicates with the hole around the pipe, and extends through the body to and through nipple 50 to communicate with an air flow hose connected to the nipple. In this way, with the apparatus of the invention in position around pipe 26 and with the first end against wall 21 over hole 27, and with an air flow hose 51 secured to nipple 50 and pressured air supplied through hose 51, pressurized air is directed into the wall through hole 27. If hose 51 is connected to a source of vacuum rather than pressurized air, air is drawn out of the wall through hole 27 and into hose 51. The normally used air blower, not shown, but shown and described in the referenced related applications, may be used to supply pressurized air or to supply a source of vacuum. A resilient gasket material 55 may be provided on the first end of the body 35 to provide a seal against the wall if this is desired. In many instances, the air flow through the hole 27 will be of such nature that sealing gasket 55** is not necessary.

In use, usually the decorative flange covering the hole around a pipe as it extends from a wall, ceiling, or floor will be removed and the apparatus of the invention installed over the pipe against the wall. In some instances, however, chamber 54 can be made large enough so that flange 57, FIG. 3, is merely moved slightly away from the wall, if necessary, to provide air flow spaced in communication with hole 27 and the apparatus of the invention is placed over the flange.

While body halves **35*a* and 35*b* can be provided in a variety of sizes to fit different size pipes, resilient gasket material 46 between mating halves 35*a* and 35*b* may be of such thickness and resilience so that several sizes of pipe can be accommodated in a single size of recesses 45*a* and 45*b*. For example, recesses 45*a* and 45*b* of somewhat larger than an inch diameter could be provided with material 46 so that pipes between about one-half to one inch outside diameter could be accepted therein. A diameter of somewhat over one-and-one-half inches could snugly accept pipes of between about three-quarter inch to one-and-one-half inch outside diameter. Usually pipes extending from walls, ceilings, or floors will be in the range of about one-half inch to one-and-one-half inches in outside diameter. In order to make one size of body useable with a larger range of pipe sizes, recesses 45*a* and 45*b*** can be made a relatively large size and inserts similar to gromets may be inserted into the recesses to provide a desired size.

Where it is desired to rigidly secure the apparatus of the invention to the pipe which it surrounds, a collar 60, FIG. 8, may be provided extending from body halves 61*a* and 61*b* with set screws 62 threaded thereinto which can be tightened about a pipe around which the apparatus is mounted to securely position the apparatus along the pipe. Various other clamping means could also be used.

With the apparatus of the invention, air circulation in hollow walls, ceilings, and floors is provided by forcing pressurized air into the walls, ceilings, or floor at locations where pipes pass through the walls, ceilings, or floor, or drawing air out of walls, ceilings, or floors at locations where pipes pass through such walls, ceilings, or floors. Air will exit or enter the walls, ceilings, or floors through other holes or cracks. In some cases, air can be forced in around some pipes while sucked from the wall around other pipes, or can be forced in or sucked out from other holes in the walls, ceilings, or floors. The advantage of using existing holes to generate air circulation is that new holes are not cut into the walls, ceilings, or floors which need to be repaired after drying is complete.

While the invention has been described in relation to drying walls, ceilings, or floors, it should be realized that the invention can be used equally as well where air circulation in hollow walls, ceilings, or floors is desired such as possibly for fumigation or other times when various gases or chemicals are desired to be circulated through walls, ceilings, or floors.

The illustrated embodiment shows the body of the apparatus as hinged so it can be opened about the hinge to be placed around a pipe. Other means of opening the apparatus so it fit around a pipe could be used, the important feature being that it can be placed around or be removed from around the pipe and that it provides a means for connecting a source of air flow to the hole in the wall, ceiling, or floor through which the pipe extends.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. Apparatus for creating air flow in a hollow wall, ceiling, or floor through an opening around a pipe extending from the wall, ceiling, or floor with a surface of the wall, ceiling, or floor surrounding the pipe, comprising:

a conduit body adapted to fit around the pipe and having a first end sized and configured to fit circumferentially around the opening around the pipe against the surface surrounding the pipe;

connecting means extending from the conduit body configured to be coupled to an air flow hose;

an air flow passage extending between and opening to the first end and the connecting means whereby air can flow through the air flow passage; and means for securing the conduit body in position around the pipe so that the first end will substantially abut the surface surrounding the pipe.

2. Apparatus for creating air flow in a hollow wall, ceiling, or floor according to claim 1, wherein the conduit body includes two separable body sections that come together around the pipe and separate for removal from around the pipe.

3. Apparatus for creating air flow in a hollow wall, ceiling, or floor according to claim 2, wherein the two separable sections are hinged together.

4. Apparatus for creating air flow in a hollow wall, ceiling, or floor according to claim 3, wherein the two separable sections are body halves.

5. Apparatus for creating air flow in a hollow wall, ceiling, or floor according to claim 4, wherein the means for securing the conduit body in position around the pipe includes latching means to latch the two body halves together.

6. Apparatus for creating air flow in a hollow wall, ceiling, or floor according to claim 5, wherein the means for securing the conduit body in position around the pipe includes resilient means surrounding the pipe.

7. Apparatus for creating air flow in a hollow wall, ceiling, or floor according to claim 6, wherein the means for receiving the conduit body in position around the pipe also includes set screw means for securing the body against sliding movement with respect to the pipe.

8. Apparatus for creating air flow in a hollow wall, ceiling, or floor according to claim 6, wherein the first end includes gasket material which fits against the surface surrounding the pipe.

9. Apparatus for creating air flow in a hollow wall, ceiling, or floor according to claim 2, wherein the means for securing the conduit body in position around the pipe includes latching means to latch the two separable body sections together.

10. A method of creating air flow in a hollow wall, ceiling, or floor having a hole therein through which a pipe extends from the wall, ceiling, or floor with a surface of the wall, ceiling, or floor surrounding the pipe, comprising the steps of:

securing a conduit apparatus about the pipe over the hole through which the pipe extends so that an end of the conduit fits against the surface surrounding the pipe, said conduit apparatus also having a connecting means with a flow passage extending between the connecting means and the end;

connecting the connecting means to a source of air flow;

and operating the source of air flow to cause air flow around the pipe through the hole through which the pipe extends from the wall, ceiling, or floor.

11. A method of creating air flow in a hollow wall, ceiling, or floor according to claim 10, wherein the source of air flow is a source of pressurized air and the source of air flow is operated to force pressurized air into the wall, ceiling, or floor around the pipe.

12. A method of creating air flow in a hollow wall, ceiling, or floor according to claim 10, wherein the source of air flow is a source of vacuum and the source of air flow is operated to draw air from the wall, ceiling, or floor around the pipe.

* * * * *